US007579965B2

(12) United States Patent
Bucholz

(10) Patent No.: US 7,579,965 B2
(45) Date of Patent: Aug. 25, 2009

(54) VEHICLE DATA COLLECTION AND PROCESSING SYSTEM

(76) Inventor: Andrew Bucholz, 509 Robinson Ct., Alexandria, VA (US) 22302

( * ) Notice: Subject to any disclaimer, the term of this patent is extended or adjusted under 35 U.S.C. 154(b) by 349 days.

(21) Appl. No.: 11/681,532

(22) Filed: Mar. 2, 2007

(65) Prior Publication Data

US 2007/0208681 A1 Sep. 6, 2007

Related U.S. Application Data

(60) Provisional application No. 60/778,954, filed on Mar. 3, 2006.

(51) Int. Cl.
*G08G 1/017* (2006.01)

(52) U.S. Cl. ..... 340/937; 340/933; 340/934

(58) Field of Classification Search ..... 340/933, 340/934, 937, 901, 425.5, 426.1, 426.18, 340/426.19; 702/159; 382/103, 104, 105; 348/143, 148

See application file for complete search history.

(56) References Cited

U.S. PATENT DOCUMENTS

| | | | | |
|---|---|---|---|---|
| 4,603,390 | A | 7/1986 | Mehdipour et al. | |
| 5,263,118 | A | 11/1993 | Cornelison | |
| 5,414,624 | A | 5/1995 | Anthonyson | |
| 5,515,042 | A | 5/1996 | Nelson | |
| 5,568,406 | A | 10/1996 | Gerber | |
| 5,737,710 | A | 4/1998 | Anthonyson | |
| 5,809,161 | A | 9/1998 | Auty | |
| 5,922,040 | A | 7/1999 | Prabkaran | |
| 5,986,543 | A | 11/1999 | Johnson | |
| 6,081,206 | A | 6/2000 | Keilland | |
| 6,121,898 | A | 9/2000 | Moetteli | |
| 6,433,706 | B1 | 8/2002 | Anderson, III et al. | |
| 6,641,038 | B2 * | 11/2003 | Gehlot et al. | 235/384 |
| RE38,626 | E | 10/2004 | Keilland | |
| 6,982,654 | B2 * | 1/2006 | Rau et al. | 340/937 |
| 7,046,169 | B2 | 5/2006 | Bucholz et al. | |
| 7,412,078 | B2 * | 8/2008 | Kim | 382/105 |

FOREIGN PATENT DOCUMENTS

KR 2001/107383 A * 12/2001

* cited by examiner

*Primary Examiner*—Van T. Trieu
(74) *Attorney, Agent, or Firm*—24IP Law Group; Timothy R. DeWitt

(57) ABSTRACT

A system for collecting, storing, linking and processing license plate data to provide compilations of information and displays of such compiled information. The system has a license plate reading system that may record time and location data in addition to license plate data, license plate image data, and image data of a vehicle. The data is collected over an extended period of time and stored for later searching. The data may be correlated, indexed and/or categorized in storage. The collected data may be compared to various existing or other databases and correlated and/or indexed to such databases. That collected data may be processed, searched, and/or analyzed for a variety of purposes.

14 Claims, 8 Drawing Sheets

VEHICLE DATA COLLECTION AND PROCESSING SYSTEM

CROSS-REFERENCE TO RELATED APPLICATIONS

The present invention claims the benefit of the filing date of U.S. Provisional Patent Application Ser. No. 60/778,954 filed on Mar. 3, 2006 by Andrew J. Bucholz.

The present invention relates generally to the subject matter disclosed in U.S. Utility patent application Ser. No. 11/217,002 filed Aug. 31, 2005 now U.S. Pat. No. 7,046,169 by inventors Andrew J. Bucholz, Patrick D. Minix, and Matthew D. Roberts.

These prior applications are hereby incorporated by reference in their entirety.

BACKGROUND OF THE INVENTION

1. Field of the Invention

The present invention relates to the field of vehicle surveillance systems, and more particularly, to data collected using vehicle surveillance systems and the processing of such data.

2. Brief Description of the Related Art

Various systems for collecting and using vehicle data are known. For example, U.S. Pat. No. RE38,626 entitled "Parking Regulation Enforcement System" discloses a system for scanning vehicle license plates and various embodiments for using the scanned data in applications such as parking enforcement and locating lost vehicles. Additionally, the patent suggests the comparison of license plate data to various databases, such as stolen vehicle, outstanding warrant or suspended license databases. Comparisons of license plate data to various other databases likewise have been suggested, such as databases of tax liens and outstanding parking tickets.

Another example of a prior system is disclosed in U.S. Pat. No. 5,809,161 to Auty. The Auty patent scans license plates at various points along a route and uses the license plate data along with time data and distance data to calculate average speeds as a means for enforcing speed limits. The Auty patent suggests other uses of the collected data such as comparing scanned license plate data with databases of stolen vehicles.

Another example is found in U.S. Pat. No. 4,603,390 to Mehdipour, which discloses a system for monitoring and charging fees in connection with one or more parking lots.

Such prior systems have been effective to varying degrees for various purposes. Such systems, however, lack comprehensive storage of collected data over an extended period of time and the analysis of such data.

SUMMARY OF THE INVENTION

The present invention is a system for collecting, storing, linking and processing license plate data to provide compilations of information and displays of such compiled information. In a preferred embodiment, the system has a license plate reading system that may record time and location data in addition to license plate data, license plate image data, and image data of a vehicle. The data is collected over a short period of time or over an extended period of time and stored for later searching. The data may be correlated, indexed and/or categorized in storage. The collected data may be compared to various existing or other databases and correlated and/or indexed to such databases. That collected data may be processed, searched, and/or analyzed for a variety of purposes.

In a preferred embodiment, the present invention is a method for identifying abandoned stolen vehicles. The method comprises the steps of collecting vehicle data over a first interval of time, storing the vehicle data, comparing a license plate number of a stolen vehicle to the collected vehicle data, and processing results of the comparison to determine whether the license plate number of the stolen vehicle appears in the collected vehicle data a plurality of times during a second interval of time in a single location, wherein the second interval of time is greater than or equal to two days and is at least a portion of the first interval of time. The vehicle data may comprise scanned license plate numbers correlated with dates, times, locations, images of license plates, images of vehicles or other information. The first and second intervals of time may be selected and modified over time based upon experience in particular geographic regions. An approximate minimum interval for which a vehicle must be found in the same location to determine is have been abandoned, i.e., the second interval, likely would be two days, but a longer interval, such as five days, would have greater accuracy. Similarly, different lengths of time may be used for he first interval, such as seven, thirty, ninety or three hundred sixty days. The processing step may be carried out in a number of different manners, such as comparing the collected vehicle data to a database of stolen vehicles or by comparing data of individual stolen vehicles to the collected vehicle data.

In another embodiment, the invention comprises a method for determining residency that comprises the steps collecting vehicle data over an interval of time greater than or equal to a predetermined time period, the vehicle data comprising scanned license plate numbers correlated with dates and locations at which license plates were scanned, storing said collected vehicle data and processing the vehicle data to correlate vehicles with geographic regions of residency. In a preferred embodiment, the processing may comprise identifying a plurality of instances in which a license plate of a first vehicle was scanned in a particular region during a during a time interval equal to or greater than the predetermined time period.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRITION OF THE DRAWINGS

For a more complete understanding of the present invention and the advantages thereof, reference is now made to the following description and the accompanying drawings, in which.

DETAILED DESCRIPTION OF THE PREFERRED EMBODIMENTS

Figure 1:
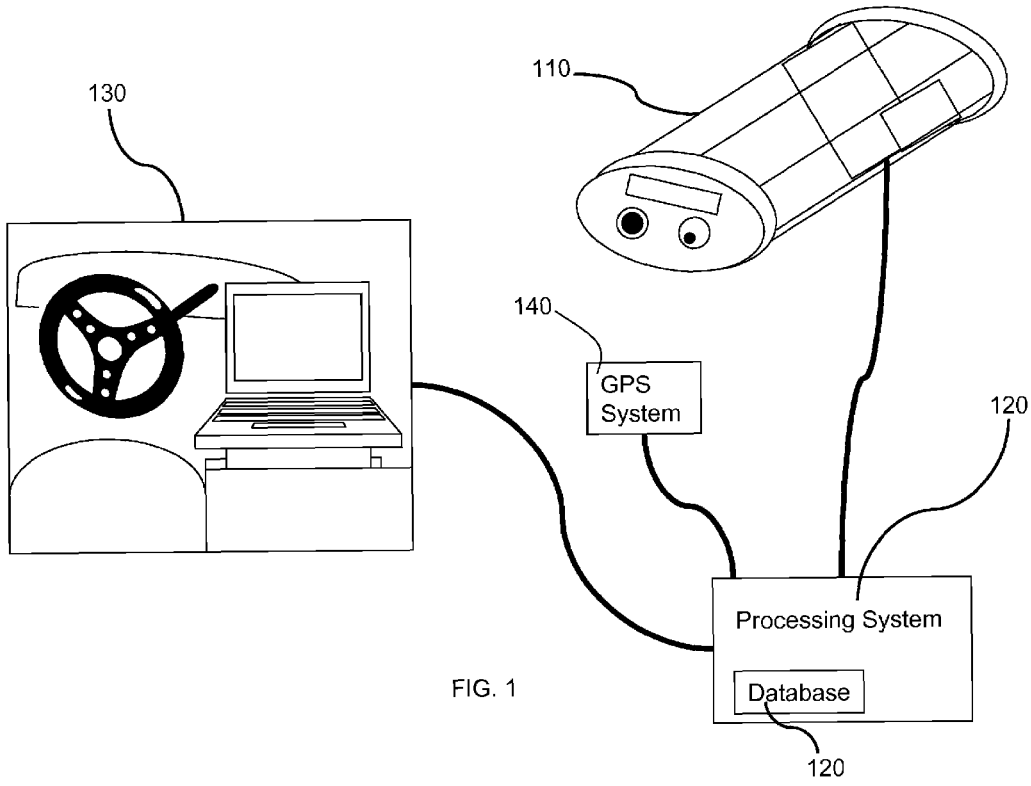
FIG. 1 is a basic diagram of a conventional mobile license plate reading system.

The present invention may be used with various known or future developed license plate reading systems. An example of a typical license plate reading system shown in FIG. 1. The typical system 100 has a camera system 110, a processing system 120 and a display 130. The display 130 may be, for example, a laptop computer having a keyboard 132 or other input means. The system further would include means for determining a location or approximate location of a vehicle whose license plate is being scanned. For mobile license plate reading systems, the means for determining a location could be, for example, a GPS or RFID system 140. Examples of such means for determining a location of a vehicle are disclosed and described, for example, in U.S. Pat. No. RE 38,626 to Keilland and U.S. patent application Ser. No. 11/466,005, both of which are hereby incorporated by reference in their entirety. These are only examples, as any means for locating a vehicle may be sued.

Figure 2:
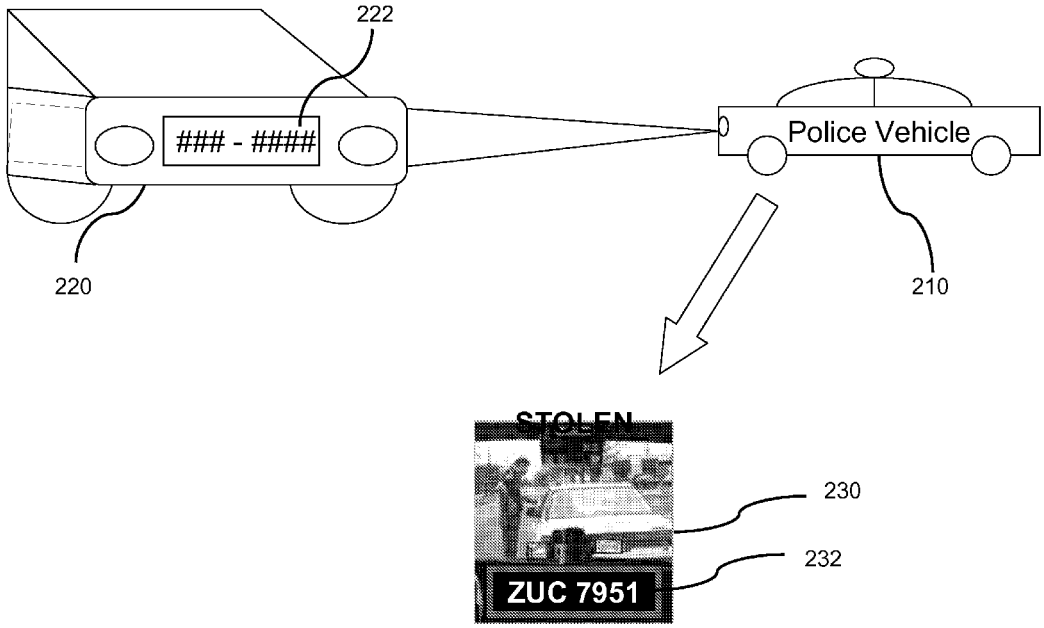
FIG. 2 is a diagram illustrating a use of a mobile license plate reading system.

An example of typical use of such a system is shown in FIG. 2. An officer on routine patrol in a cruiser 210 equipped with a license plate reading system 100 scans license plates of vehicles, which may be parked or moving. A stolen vehicle 220 drives past the patrol vehicle 210. The license plate reading system 100 takes an image of the license plate 222 of the vehicle 220 and extracts the license plate number 232 from the image. The processor 120 compares license plate data 232 to a database 122 of stolen vehicles and identifies the vehicle 220 as a stolen vehicle 230. The officer then takes appropriate action.

Figure 3:
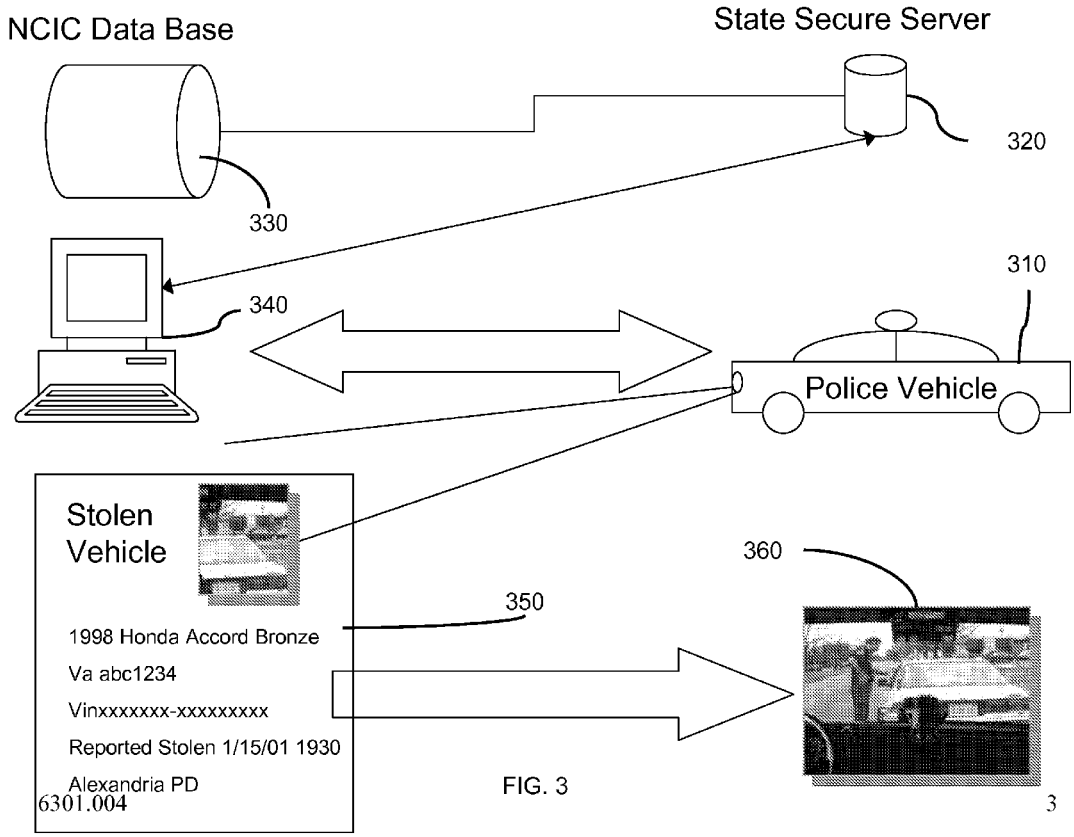
FIG. 3 is a diagram illustrating the flow of data in an embodiment of the present invention.

In the present invention, various sources of data are shared, as shown by way of example in FIG. 3. A police cruiser 310 equipped with a license plate reading system 100 communicates with a local police communications room 340. The local police communications room in turn communicates with a secure state server 320, which has, for example, warrant and suspended or revoked drivers license databases. The secure state server 320 communicates with various other database servers such as the NCIC database 330 of stolen auto, stolen license plate, and felony vehicle databases. The patrol vehicle 310 scans a license plate of a vehicle and either locally or through communications with the various servers compares the scanned license plate to the various databases and identifies record information 350 corresponding to the scanned license plate.

Figure 4A:
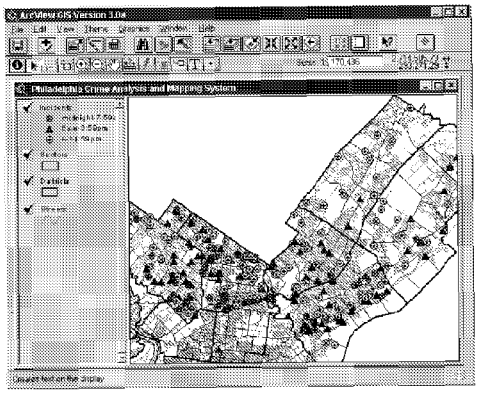
FIG. 4(a) PRIOR ART
FIG. 4 is a diagram illustrating prior art crime analysis and mapping displays.
Figure 4B:
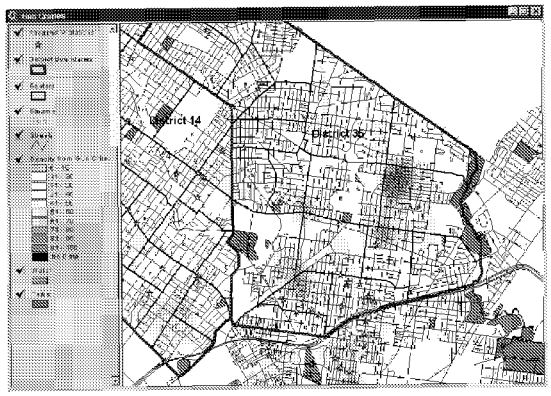
FIG. 4(b) PRIOR ART

FIGS. 4(*a*) and (*b*) shows two traditional analysis and mapping displays used by law enforcement officials. Although the data on these displays can show trends, it lacks specifics needed to make arrests.

In a preferred embodiment of the present invention, various vehicle data collection systems are employed to collect large volumes of vehicle data including times, locations and license plate number. The data collection systems may be stationary or moving and the vehicles being scanned may be stationary or moving. Examples of stationary surveillance points could be toll booths, bridges, parking lots or even a building located at busy intersections. The stationary surveillance locations are not limited to public locations, but also may be parking lots or other private locations. Mobile data collection systems may be located on parking enforcement vehicles, patrol vehicles, taxi cabs, garbage trucks, or really any mobile vehicle. The data is collected and stored and may be correlated with prior collected data for the same vehicle. The data may be collected and stored over a period of time, such as weeks, months or even years. The collected data may show multiple scans of a single vehicle.

Figure 5:
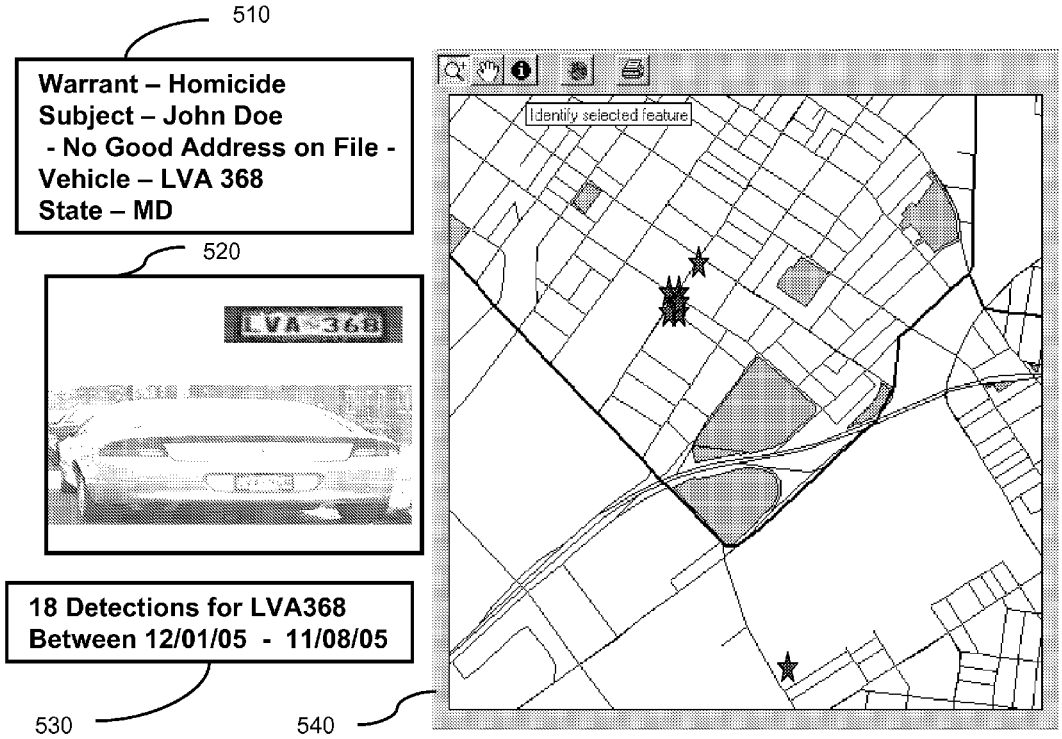
FIG. 5 is a diagram illustrating correlation of stored data in an embodiment of the present invention.

In the example shown in FIG. 5, a search of the database may be performed for a particular license plate(s) or vehicle(s) associated with an individual having a warrant out for his or her arrest. The vehicle(s) or license plate(s) could be registered to the individual, a family member, spouse, girlfriend/boyfriend, friend or any vehicle that can be associated with that individual. As shown in FIG. 5, the database can be searched and can generate and display information identifying a limited geographic region or regions, such as a few city blocks, in which the subject vehicle(s) have been recorded multiple times over a particular time interval. The regions identified by the system can then be searched or monitored for the particular suspect. Alternatively, the results could be further correlated with information about that particular region, such as the location of restaurants, apartment buildings, etc., that the individual may be frequenting.

Figure 6:
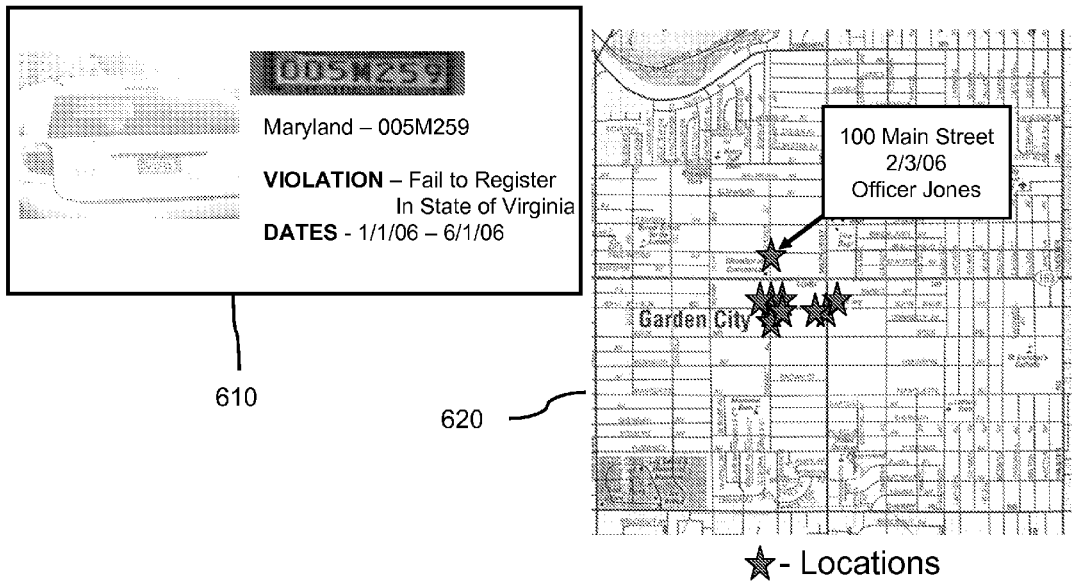
FIG. 6 is a diagram illustrating an embodiment of the invention for establishing proof of residence.

The collected and stored data may be processed and used in a variety of other applications. In an embodiment of the invention shown in FIG. 6, the data may be processed and used in connection with establishing proof of residence. Jurisdictions want to ensure that vehicle owners have properly registered their vehicles. It is a common problem to have vehicle owners improperly register their vehicles for either the new or correct state or fail to register in the new local jurisdiction within a state, or fail to update their new address to avoid such things as paying car taxes, higher insurance rates, or just registering at all. As shown in FIG. 6, a license plate number is compared to a collected database to identify instances in which the subject license plate was scanned by a vehicle surveillance system. By identifying multiple scans of the same vehicle license plate and analyzing the locations and times of such scans, a pattern of behavior of a particular vehicle can be identified and an area of residence of the owner of the vehicle may be established or deemed enough evidence to call into question the area of residence for further investigation and or a citation.

The same type of example could be performed, for example, in connection with automobile insurance. Specifically, the collected data could be compared to a database of insured vehicles to compare the region in which a vehicle is actually being kept to the location listed in the insurance data where the vehicle is being kept. In this manner, an insurance company can identify vehicles for which incorrect insurance data has been provided. This commonly occurs when people who live in high crime areas, and in particular areas having high auto theft rates, seek to reduce their insurance rates by stating to the insurance company that the vehicle is being house in a different location, such as the home of a relative, in an area having a lower crime rate. The search of the collected data could be performed routinely by insurance companies to identify individuals that should be paying higher rates or could be performed after a vehicle is reported stolen to reduce or eliminate payment of the insurance claim.

Figure 7:
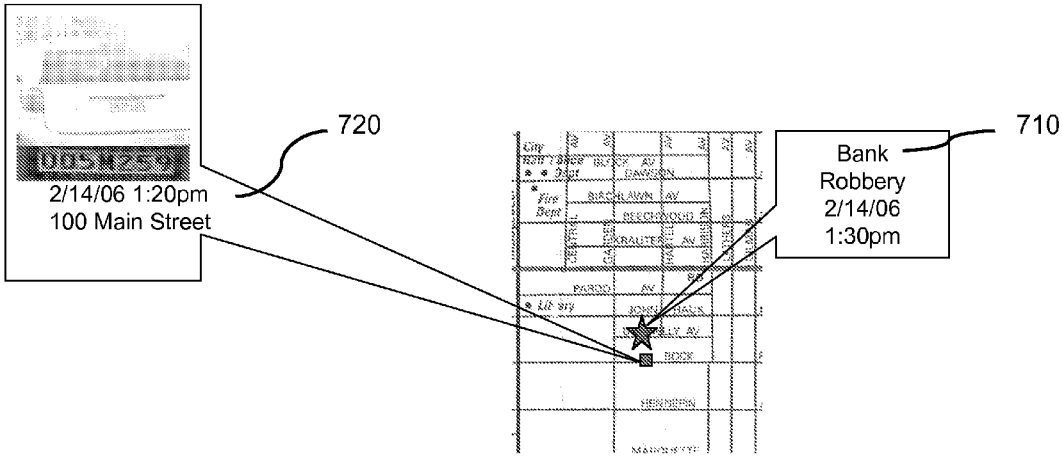
FIG. 7 is a diagram illustrating an embodiment of the present invention for use as an investigative tool.

An embodiment in which the collected data is used as an investigative tool is described with reference to FIG. 7. Data gathered from license plate readers can have many investigative benefits. Such things as date, time, location, picture of the license plate, and picture of the vehicle are all evidence for an investigation. For example, a bank robbery occurs where there is a witness who reports that the suspect vehicle was a white Chrysler mini-van with a dented bumper but the witness could not remember the license plate number.

An officer checks to see if any license plate readers were in the vicinity around the time of the bank robbery 710—and there were. The officer checks overview images for a white mini-van and there is a match 720. The witness confirms that "yes, this is the vehicle." The officer now has a suspect with evidence for court. This type of search also is good for when the witness only remembers part of the license plate number. With just "005" on a white minivan, the officer could search by partial plate read and/or color overview.

Figure 8:
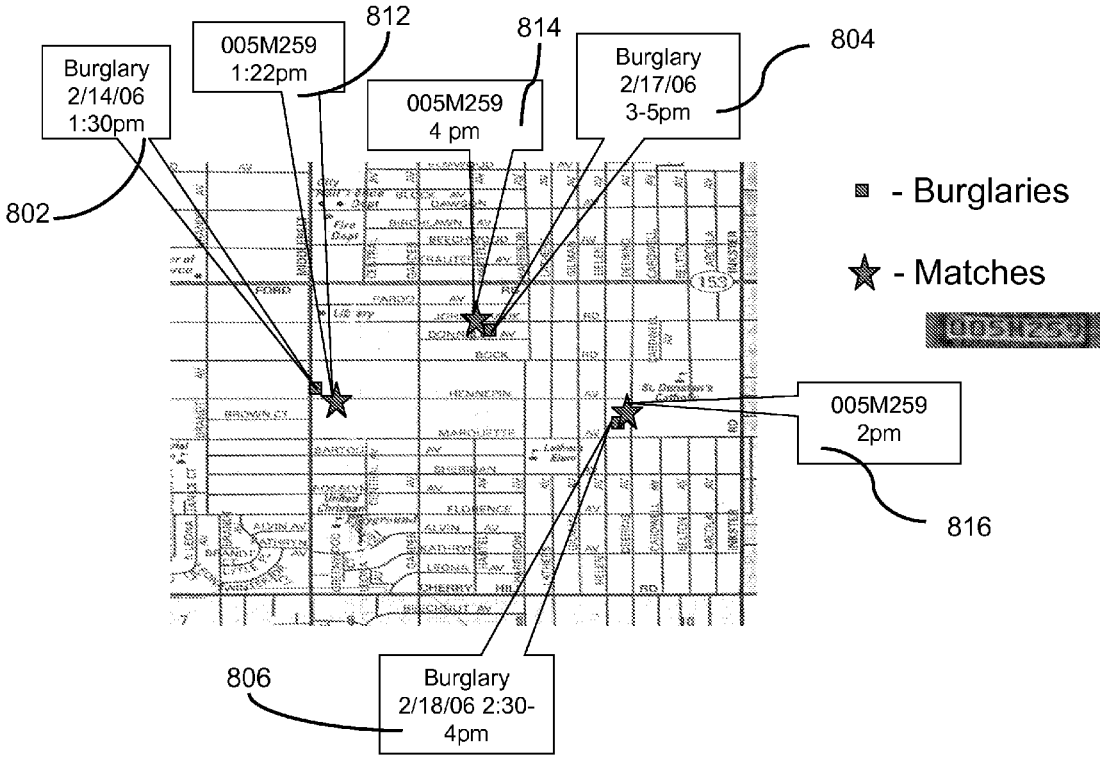
FIG. 8 is a diagram of illustrating an embodiment of the present invention for serial crime analysis.

Example of the use of collected data in solving a serial crime is described with respect to FIG. 8. Investigators often find that a suspect(s) will commit the same crime over and over. Gathered data from license plate readers can assist an investigator in placing a known suspect's vehicle at the scene of a crime or by spatial analysis they can generate leads to identify an unknown suspect. For instance, three burglaries have occurred where the modis operandi are the same. The officer knows the location and general time frames when the burglaries occurred and checks to see if any license plate readers recorded the same license plate number 812, 814 in at least two or all three of the locations (this could be for parked or moving vehicles). Another method for investigating the same three burglaries happens when an officer does not know the crimes are connected but is checking to see if license plate numbers match in any of the areas near the burglaries.

Another area of use of the present invention is warrant conversion. Jurisdictions (whether they are at the local, state, or Federal level) have criminal and civil warrants that they are trying to serve. Serving these warrants is often difficult because suspects have listed a bad address or are transient in nature. Comparing the information listed on a warrant to the identification of a vehicle or vehicles that the wanted individual may own will assist in finding the wanted person.

For Instance: Wanted person "John Doe" with robbery warrant on file in Cupcake County whose listed address as 100 Main Street is a bad address (he moved 6 months ago). His particulars are—White Male, 6', Red Hair, SS #123-45-6789. Department of Motor Vehicles—Has on file a John Doe who registered his vehicle (Ford Truck) at 100 Main Street with license plate number ABC-123. When these two databases are matched together they create a database for a license plate reader. Other databases can be constructed in the same manner—people listed as sexual predators who have not registered with the proper authorities, terrorists on a watch list, etc.

Sometimes people are barred from certain locations, for example, a protective order bars John Doe with license plate number ABC-123 from getting within 500 yards of Jane Doe or sexual predators from being too close to a school. Sometimes people are barred from associating with other people like the case of identified gang members with gang activity. License plate readers can alert the officers when specific license plates are within a certain area (using GPS and other location identifiers) and they can also alert to groups of license plates in proximity to each other for criminal activity like gang members gathering.

The data gathered from license plate reader(s) can also be used for placing a suspect or suspect's vehicle at the scene of a crime. For instance, John Doe commits a homicide and seemingly has an alibi that places him somewhere other than the vicinity of the crime. With the data gathered from a moving or stationary license plate reader(s) John Doe's license plate might have been recorded near the scene of the crime near the time in question.

A license plate reader(s) can be used to gather data for an area for the purpose of identifying where vehicles are moving or parked (this could be over a short period of time or over a long period of time). This snapshot of vehicles, locations, and time can be used as a baseline of gathered data of license plates to be checked against all types of criminal activity, criminal trends, and criminal behavior. This baseline could be used to identify where wanted individuals who own vehicles are parking, if sexual predators who own vehicles have moved without reporting their new address, if persons on probation or parole who own vehicles have moved without notifying the authorities or are associating with individuals that they should not be associating with, and other criminal activity tracking.

The data gathering and analysis of the present invention can be useful for other purposes as well. A license plate reader(s) can be used to gather data for an area for the purpose of identifying where vehicles are parked (this could be over a short period of time or over a long period of time). This snapshot of vehicles, locations, and time can be used as a baseline of gathered data of license plates driven on a certain road, entering a certain store(s), traveling back and forth, visiting a location, etc. A license plate reader(s) can be used to gather license plate numbers that will be matched to a specific person or area for commercial purposes such as mass advertising mailers, travel trends, marketing, and other driving behaviors.

In still another embodiment, the invention may take the form of a system for identifying stolen automobiles that have been abandoned. Specifically, automobiles are commonly stolen and used by the thief for transportation. Since it commonly takes several days for the identity of a stolen vehicle to become available to police officers, the thief commonly will drive the car for several days and the, when the thief believes the vehicle has been entered into the police database, is abandoned by the thief. This type of abandonment is a significant problem for insurance companies. Specifically, when a vehicle is reported stolen to an insurance company, there is typically a waiting period, such as thirty days, before the insurance company declares the vehicle "totaled" and pays the claim. If the vehicle is found before payment is made, the vehicle can be returned to the owner thereby limiting or eliminating payment of the claim by the insurance company. If the vehicle is found after the vehicle has been declared "totaled" and the insurance claim has been paid, however, the insurance company takes possession of the recovered vehicle and typically sells the vehicle at salvage prices. This results in large losses by the insurance companies. With the present system, the data collected over a period of time can be searched for stolen vehicles after the point in time at which the vehicles are typically abandoned, for example, a week after a vehicle was stolen but before the insurance company pays the claim. If the vehicle shows up multiple times in the exact same location, it can be determined that the vehicle was abandoned and the vehicle can be recovered rather than paying the insurance claim.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A method for identifying abandoned stolen vehicles comprising the steps of:

collecting vehicle data over a first interval of time, said first interval being greater than or equal to seven days, said vehicle data comprising scanned license plate numbers correlated with dates and locations at which license plates were scanned;

storing said vehicle data;

comparing a license plate number of a stolen vehicle to said collected vehicle data; and processing results of said comparison to determine whether said license plate number of said stolen vehicle appears in said collected vehicle data a plurality of times during a second interval of time in a single location, wherein said second interval of time is greater than or equal to two days and is at least a portion of said first interval of time.

2. A method for identifying abandoned stolen vehicles according to claim 1, wherein said vehicle data further comprises an image of a license plate.

3. A method for identifying abandoned stolen vehicles according to claim 1, wherein said vehicle data further comprises an image of at least a portion of a vehicle.

4. A method for identifying abandoned stolen vehicles according to claim 1, wherein said first interval of time comprises at least thirty days.

5. A method for identifying abandoned stolen vehicles according to claim 1, wherein said second interval of time comprises at least seven days.

6. A method for identifying abandoned stolen vehicles according to claim 1, wherein said second interval of time comprises at least fourteen days.

7. A method for identifying abandoned stolen vehicles according to claim 1, wherein said processing step comprises comparing said vehicle data to a database of stolen vehicles.

8. A method for determining residency comprising the steps:

collecting vehicle data over an interval of time greater than or equal to a predetermined time period, said vehicle data comprising scanned license plate numbers correlated with dates and locations at which license plates were scanned;

storing said collected vehicle data; and processing said vehicle data to correlate vehicles with geographic regions of residency.

9. A method for determining residency according to claim 8 wherein said processing step comprises the steps of:

identifying a plurality of instances in which a license plate of a first vehicle was scanned in a particular region during a during a time interval equal to said predetermined time period.

10. A method for identifying a region to associate with an individual comprising the steps of:

collecting vehicle data over an interval of time, said vehicle data comprising scanned license plate numbers correlated with dates and locations at which license plates were scanned;

storing said collected vehicle data;

comparing a license plate of interest to said collected vehicle data; and displaying information identifying a limited geographic region in which said license plate was scanned a plurality of times over a particular time interval.

11. A method for identifying a region to associate with an individual according to claim 10, wherein said displaying step comprising printing a map with a plurality of locations at which said license plate was scanned identified on said map.

12. A method for identifying a region to associate with an individual according to claim 10, wherein said license plate of interest comprises a license plate of a vehicle registered to said individual.

13. A method for identifying a region to associate with an individual according to claim 10, wherein said license plate of interest comprises a license plate of a vehicle registered to a relative of said individual.

14. A method for identifying a region to associate with an individual according to claim 10, wherein said license plate of interest comprises a license plate associated with a crime.

* * * * *